US007621320B2

(12) United States Patent
Muto et al.

(10) Patent No.: US 7,621,320 B2
(45) Date of Patent: Nov. 24, 2009

(54) INTERNAL HEAT EXCHANGER

(75) Inventors: Ken Muto, Toyota (JP); Etsuo Hasegawa, Nagoya (JP); Masaaki Kawakubo, Obu (JP); Yoshiki Katoh, Chita-gun (JP)

(73) Assignee: DENSO CORPORATION, Kariya (JP)

( * ) Notice: Subject to any disclaimer, the term of this patent is extended or adjusted under 35 U.S.C. 154(b) by 557 days.

(21) Appl. No.: 11/649,319

(22) Filed: Jan. 3, 2007

(65) Prior Publication Data

US 2007/0107887 A1 May 17, 2007

Related U.S. Application Data

(63) Continuation-in-part of application No. 10/901,476, filed on Jul. 28, 2004, now abandoned.

(30) Foreign Application Priority Data

Jul. 29, 2003 (JP) ..... 2003-281817

(51) Int. Cl.
*F28D 7/00* (2006.01)
*F25B 41/00* (2006.01)

(52) U.S. Cl. ..... 165/164; 165/177; 62/513

(58) Field of Classification Search ..... 165/164, 165/177; 62/113, 114, 513
See application file for complete search history.

(56) References Cited

U.S. PATENT DOCUMENTS

| | | | | |
|---|---|---|---|---|
| 6,540,015 | B1 * | 4/2003 | Kawachi et al. | 165/164 |
| 6,866,090 | B2 * | 3/2005 | Takamatsu et al. | 62/513 |
| 6,871,511 | B2 * | 3/2005 | Okaza et al. | 62/498 |
| 6,883,601 | B2 * | 4/2005 | Ullrich et al. | 165/177 |
| 6,935,414 | B2 | 8/2005 | Kawakubo et al. | |
| 6,962,059 | B2 * | 11/2005 | Okaza et al. | 62/513 |
| 2001/0020786 | A1 | 9/2001 | Takamatsu et al. | |
| 2003/0178188 | A1 * | 9/2003 | Coleman | 165/164 |
| 2004/0089439 | A1 * | 5/2004 | Treverton et al. | 165/164 |
| 2004/0206109 | A1 * | 10/2004 | Nishiwaki et al. | 62/114 |

FOREIGN PATENT DOCUMENTS

| | | |
|---|---|---|
| JP | 2001-056188 | 2/2001 |
| JP | 2001-277842 | 10/2001 |
| JP | 2002-098486 | 4/2002 |
| JP | 2002-174448 | 6/2002 |
| JP | 2002-340485 | 11/2002 |
| JP | 2003-121086 | 4/2003 |

OTHER PUBLICATIONS

Office Action dated Mar. 13, 2008 in Japanese Application No. 2003-281817 with English translation thereof.

* cited by examiner

*Primary Examiner*—Leonard R Leo
(74) *Attorney, Agent, or Firm*—Harness, Dickey & Pierce, PLC

(57) ABSTRACT

In an internal heat exchanger, when a corresponding diameter of a high pressure passage 5*a* is Ψh, a passage length Lh of the high pressure passage (5*a*) is so set as to satisfy the relation $9.16/\{LN(4.5^{-\Psi h}+1.03)\}<Lh<46/\{LN(4.5^{-\Psi h}+1.03)\}$, and when a corresponding diameter of a low pressure passage 5*c* is Ψl, a passage length Ll of the low pressure passage 5*c* is so set as to satisfy the relation $9.16/\{LN(0.56\times6^{-\Psi l}+1.02)\}<Ll<46/\{LN(0.56\times6^{-\Psi l}+1.02)\}$, a passage sectional area Ah of the high pressure passage 5*a* is so set as to satisfy the relation $100\times(0.25\times\Psi h^{1.2})^{-1/(0.04\times\Psi h+1.7)}\geqq Ah\geqq100\times(500\times\Psi h^{1.2})^{-1(0.04\times\Psi h+1.7)}$, and a passage sectional area Al of the low pressure passage 5*c* is so set as to satisfy the relation $1.65/\Psi l^{0.67}<Al<626/\Psi l^{0.67}$.

7 Claims, 5 Drawing Sheets

[LOW PRESSURE SIDE]

[HIGH PRESSURE SIDE]

INTERNAL HEAT EXCHANGER

CROSS-REFERENCE TO RELATED APPLICATIONS

This application is a continuation-in-part of U.S. patent application Ser. No. 10/901,476 filed on Jul. 28, 2004. This application claims the benefit of JP 2003-281817, filed Jul. 29, 2003. The disclosures of the above applications are incorporated herein by reference.

FIELD

The present disclosure relates to a vapor compression type refrigerator using carbon dioxide as a refrigerant, between internal heat exchangers, for conducting heat exchange between a high pressure side refrigerant and a low pressure side refrigerant.

DESCRIPTION OF THE RELATED ART

Most internal heat exchangers applied to vapor compression type refrigerators are employed to perform heat exchange between a high pressure side refrigerant flowing into a pressure reduction device such as an expansion valve and a low pressure refrigerant sucked into a compressor, to lower the temperature and enthalpy of the refrigerant flowing into the pressure reduction device and to improve a refrigeration capacity of the vapor compression type refrigerators by increasing a heat absorption quantity in an evaporator, that is, a rising amount of enthalpy in the evaporator.

When such an internal heat exchanger is used, the capacity of the vapor compression type refrigerator can be improved. Because the number of components constituting the vapor compression type refrigerator increases in this case, the size of the internal heat exchanger must be reduced in order to mount a vapor compression type refrigerator having the internal heat exchanger into an air conditioner for a car having a limited mounting space.

When the size of the internal heat exchanger is merely reduced, the high pressure side refrigerant cannot sufficiently be cooled in the internal heat exchanger, and the refrigeration capacity of the vapor compression type refrigerator cannot sufficiently be improved.

SUMMARY

In view of the problems described above, the invention is directed to provide, in the first place, a novel internal heat exchanger different from internal heat exchangers of the prior art and to provide, in the second place, an internal heat exchanger suitable for a vapor compression type refrigerator using carbon dioxide as a refrigerant.

To accomplish these objects, a first aspect of the invention provides an internal heat exchanger applied to a vapor compression type refrigerator using carbon dioxide as a refrigerant, having a high pressure passage (5*a*) through which a high pressure refrigerant flows and a low pressure passage (5*c*) through which a low pressure side refrigerant flows, and conducting heat exchange between the high pressure side refrigerant and the low pressure side refrigerant while the flow of the high pressure side refrigerant and the flow of the low pressure side refrigerant constitute counter-flows, wherein, when the length units are millimeters and a corresponding diameter of the high pressure passage (5*a*) is Ψh, a passage length (Lh) of the high pressure passage (5*a*) is greater than $9.16/\{LN(4.5^{-\Psi h}+1.03)\}$ and smaller than $46/\{LN(4.5^{\Psi h}+1.03)\}$, and when the length units are millimeters and a corresponding diameter of the low pressure passage (5*c*) is Ψl, a passage length (L1) of the low pressure passage (5*c*) is greater than $9.16/\{LN(0.56\times6^{-\Psi l}+1.02)\}$ and smaller than $46/\{LN(0.56\times6^{-\Psi l}+1.02)\}$.

In consequence, a compact and high performance internal heat exchanger can be obtained as shown in later-appearing FIGS. 3 and 4.

According to another aspect of the invention, there is provided an internal heat exchanger applied to a vapor compression type refrigerator using carbon dioxide as a refrigerant, having a high pressure passage (5*a*) through which a high pressure refrigerant flows and a low pressure passage (5*c*) through which a low pressure side refrigerant flows, and conducting heat exchange between the high pressure side refrigerant and the low pressure side refrigerant while the flow of the high pressure side refrigerant and the flow of the low pressure side refrigerant constitute counter-flows, wherein, when a length unit is millimeter and a corresponding diameter of the high pressure passage (5*a*) is Ψh, a passage sectional area (Ah) of the high pressure passage (5*a*) is smaller than $100\times(0.25\times\Psi h^{1.2})^{-1/(0.04\times\Psi h+1.7)}$ and greater than $100\times(500\times\Psi h^{1.2})^{-1/(0.04\times\Psi h+1.7)}$ and when the length units are millimeters and a corresponding diameter of the low pressure passage (5*c*) is Ψl, a passage sectional area (Al) of the low pressure passage (5*c*) is greater than $1.65/\Psi l^{0.67}$ and smaller than $626/\Psi l^{0.67}$.

Inconsequence, a compact and high performance internal heat exchanger can be obtained as shown in later-appearing FIGS. 5 and 6.

According to the invention, both of both of the high pressure passage and the low pressure passage (5*c*) are constituted by a plurality of passages, and wherein the number (Nh) of the high pressure passages (5*a*) is smaller than $400/(\pi\times\Psi h^2)\times(0.25\times\Psi h^{1.2})^{-1/(0.04\times\Psi h+1.7)}$ and greater than $400/(\pi\times\Psi h^2)\times(500\times\Psi h^{1.2})^{-1/(0.04\times\Psi h+1.7)}$, and the number (Nl) of the low pressure passages (5*c*) is greater than $2.1/\Psi l^{2.67}$ and smaller than $797/\Psi l^{2.67}$.

According to the invention, further, the high pressure passage (5*a*) and the low pressure passage (5*c*) are aligned on the same axis and constitute a double tube structure.

According to the invention, further, the high pressure passage (5*a*) and the low pressure passage (5*c*) are shaped into a flat shape.

The present invention may be more fully understood from the description of preferred embodiments of the invention as set forth below together with the accompanying drawings.

DRAWINGS

Figure 3:
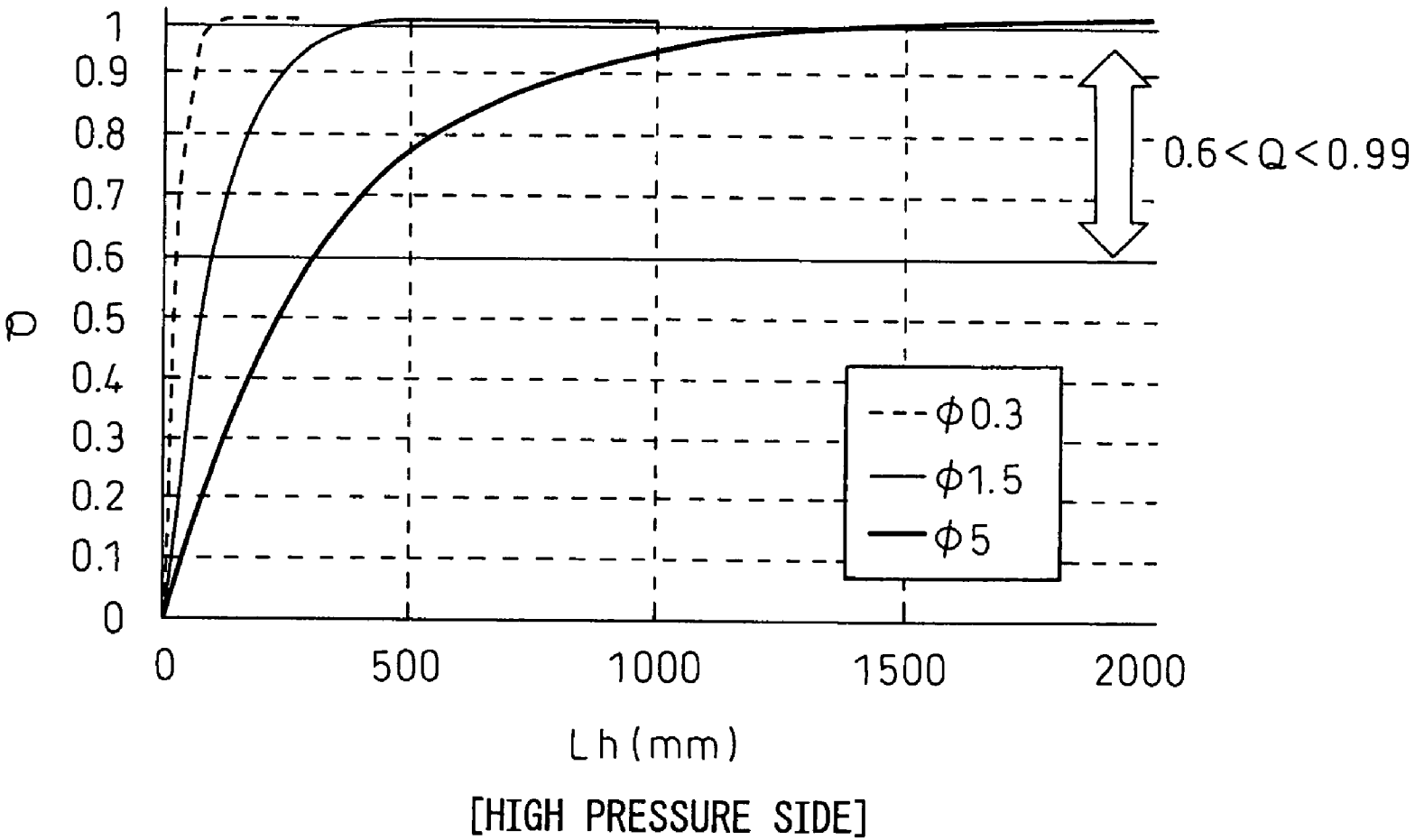
Figure 4:
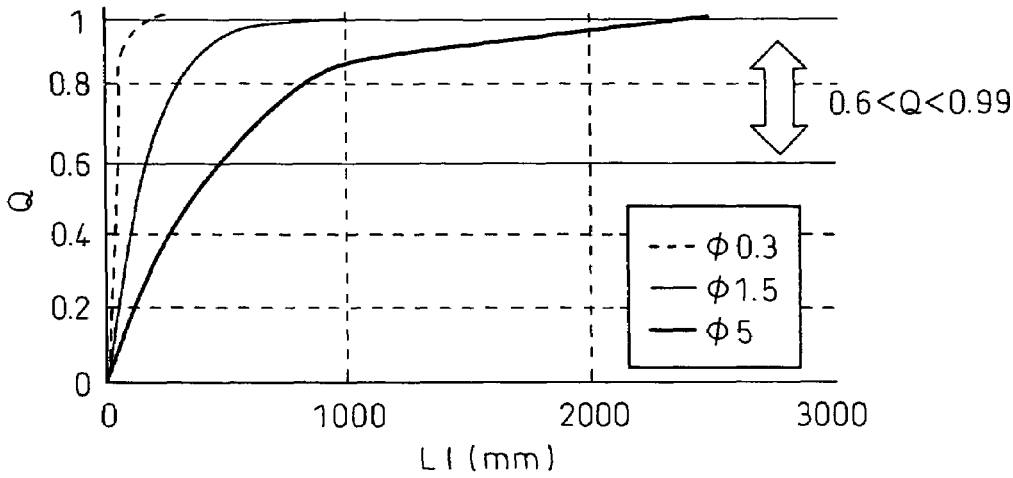
Figure 5:
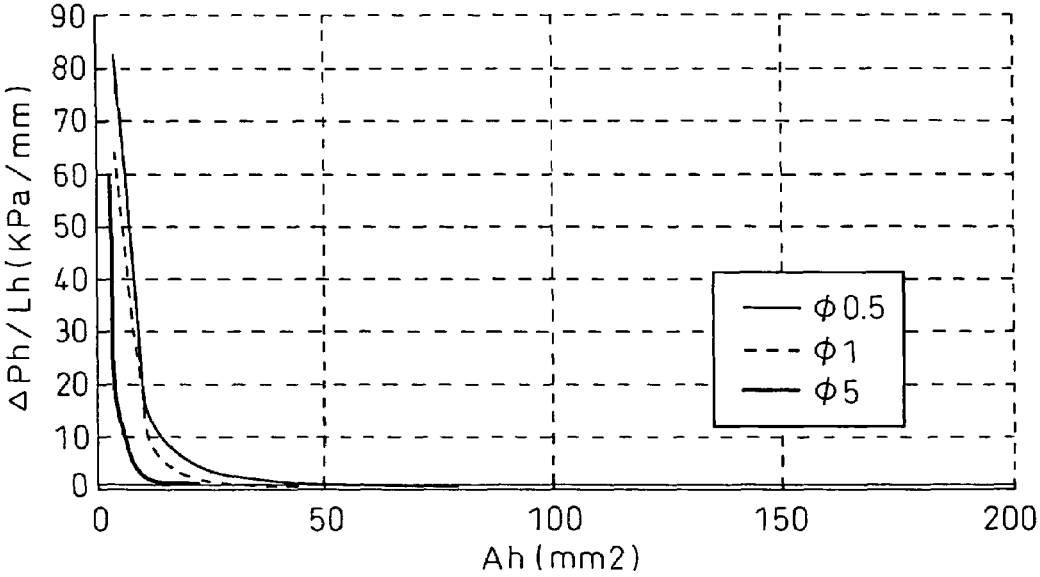
Figure 6:
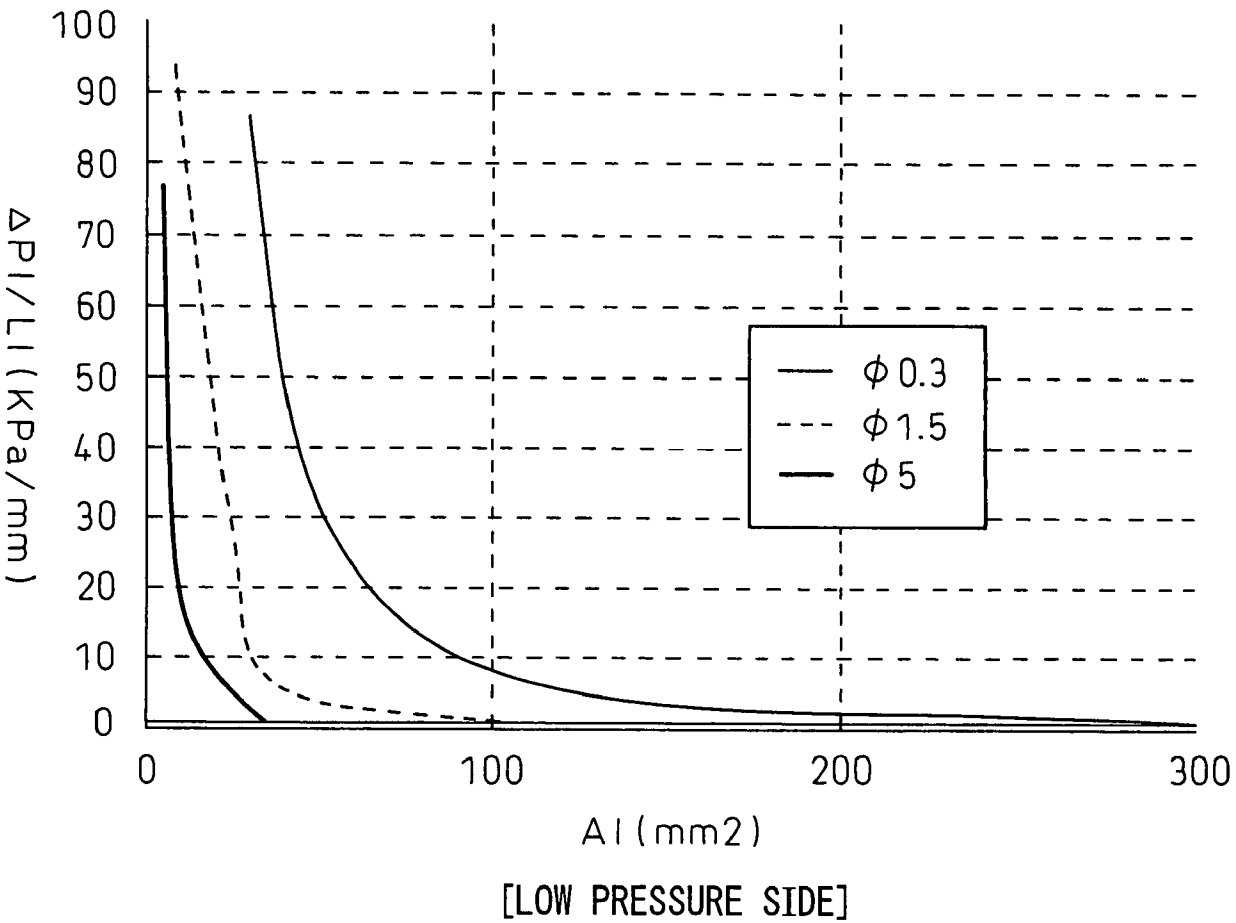
Figure 7:
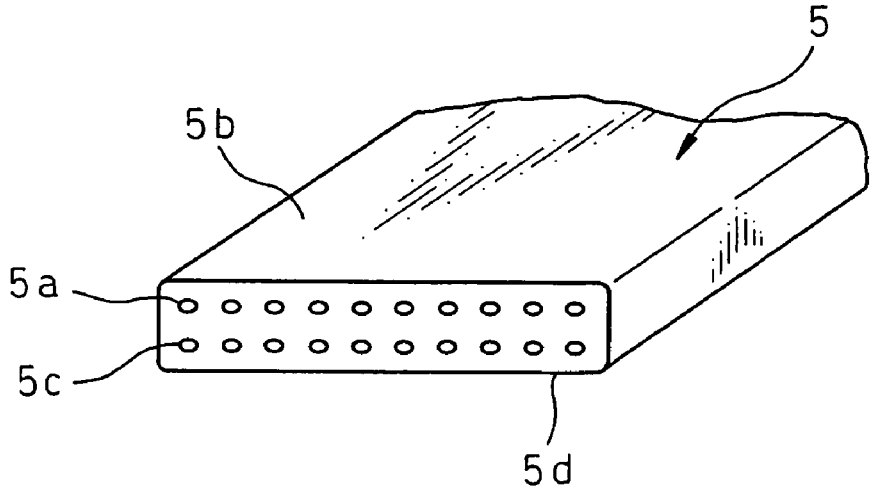
Figure 8:
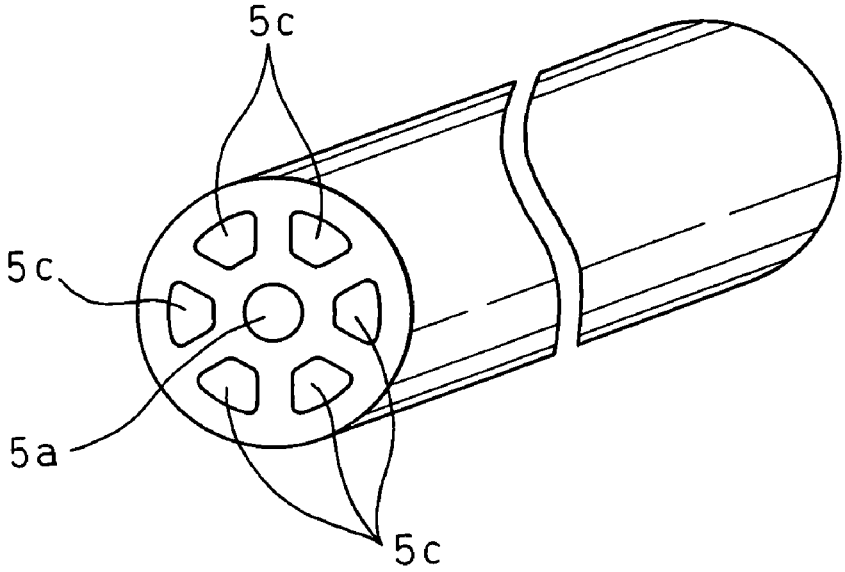

FIG. 3 is a graph showing the relation between heat exchange efficiency Q and a passage length Lh of a high pressure passage 5*a* in a high pressure tube 5*b* when a passage sectional diameter Ψ of the high pressure passage 5*a* is used as a parameter;

FIG. 4 is a graph showing the relation between heat exchange efficiency Q and a passage length L1 of a low pressure passage 5*c* in a low pressure tube 5*d* when a passage sectional diameter Ψ of the low pressure passage 5*c* is used as a parameter;

FIG. 5 is a graph showing the relation between a pressure loss ΔP/L per unit passage length and a passage sectional area Ah of the high pressure passage 5*a* in the high pressure tube 5*b* when a passage sectional diameter Ψ of the high pressure passage 5*a* is used as a parameter;

FIG. 6 is a graph showing the relation between heat exchange efficiency Q and a passage sectional area Al of the low pressure passage 5*c* in the low pressure tube 5*d* when a passage sectional diameter Ψ of the low pressure passage 5*c* is used as a parameter;

FIG. 7 is a schematic view of an internal heat exchanger according to a second embodiment of the invention; and FIG. 8 is a schematic view of an internal heat exchanger according to a third embodiment of the invention.

DESCRIPTION OF THE PREFERRED EMBODIMENTS

First Embodiment

Figure 1:
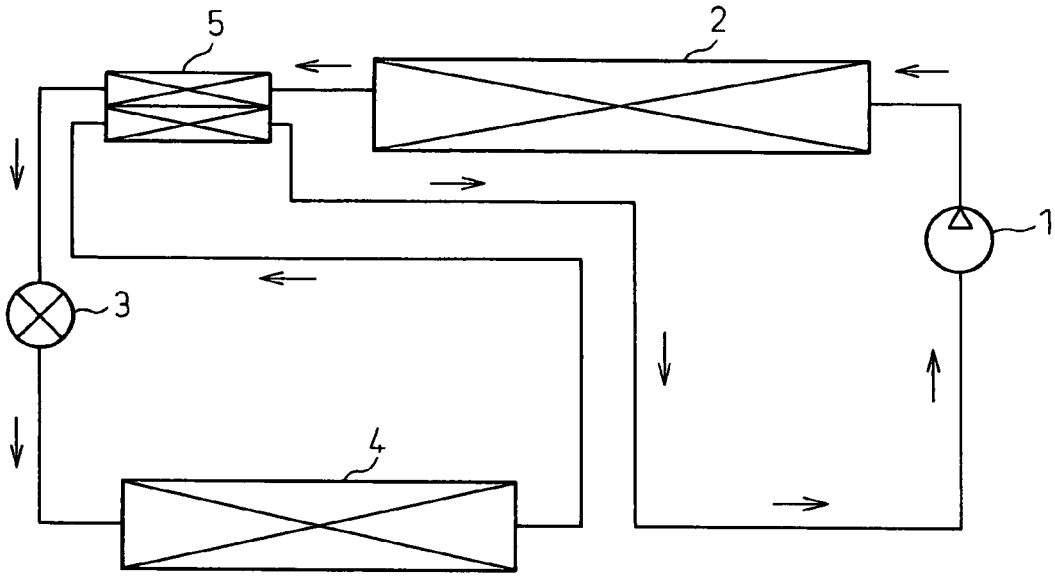
FIG. 1 is a schematic view of a vapor compression type refrigerator according to an embodiment of the invention.

In this embodiment, an internal heat exchanger for a vapor compression type refrigerator according to the invention is applied to an air conditioner for a car using carbon dioxide as a refrigerant, and FIG. 1 is a schematic view of the vapor compression type refrigerator according to the embodiment.

Referring to FIG. 1, a compressor 1 acquires power from an external driving source such as a driving source for a vehicle (e.g. internal combustion engine such as an engine) and sucks and compresses a refrigerant. A radiator 2 is a high pressure side radiator that performs heat exchange between a high pressure refrigerant ejected from the compressor 1 and external air and cools the high pressure refrigerant.

A pressure reduction device 3 reduces the pressure of the high pressure side refrigerant flowing out from the radiator 2. This embodiment uses a device that equi-enthalpically reduces the pressure such as an expansion valve or a fixed choke.

An evaporator 4 is a low pressure side heat exchanger that evaporates a low pressure side refrigerant the pressure of which is reduced by the pressure reduction device 3, performs heat exchange between the low pressure side refrigerant and air blowing into a passenger compartment and exhibits a cooling capacity by evaporating the low pressure refrigerant.

Incidentally, this embodiment uses carbon dioxide as the refrigerant and the critical temperature of carbon dioxide is as low as about 31° C. Therefore, the pressure of the high pressure side coolant, that is, the discharge pressure of the compressor 1, is set to be higher than the critical pressure of the refrigerant to secure a necessary heat radiation capacity (temperature difference). As the high pressure side refrigerant has a pressure higher than the critical pressure, its enthalpy is lowered by lowering the temperature without condensing the coolant inside the radiator 2.

Figure 2:
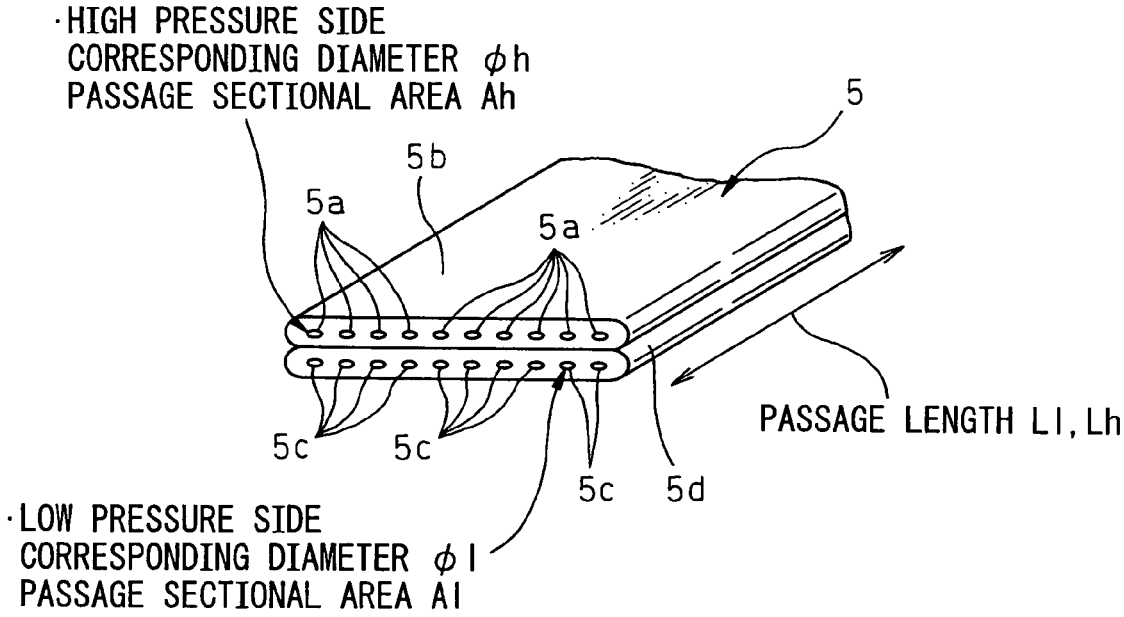
FIG. 2 is a schematic view of an internal heat exchanger according to a first embodiment of the invention.

The internal heat exchanger 5 is a heat exchanger that performs heat exchange between the low pressure side refrigerant flowing out from the evaporator 4 and the high pressure side refrigerant flowing out from the radiator 2. The internal heat exchanger 5 includes a high pressure tube 5*b* having a plurality of high pressure passages 5*a* through which the high pressure side refrigerant flows and a low pressure tube 5*d* having low pressure passages 5*c* through which the low pressure side refrigerant flows, as shown in FIG. 2.

Both tubes 5*b* and 5*d* are shaped into a flat shape by applying an extrusion process or a drawing process to a metal material such as an aluminum alloy, and both passages 5*a* and 5*c* are formed in the respective tubes 5*b* and 5*d* simultaneously with molding of the tubes 5*b* and 5*c*.

Both tubes 5*b* and 5*d* are unified by bonding by brazing, etc, in such a manner as to bring the flat surfaces into mutual and close contact with each other. Incidentally, the term "brazing" used hereby means a bonding technology that uses a brazing material or a solder without melting a base material as described in "Connection Bonding Technology" (Tokyo Electric University Press).

Incidentally, a bonding technology that uses a filler metal having a melting point of 450° C. or above is referred to as "brazing" and the filler metal used is referred to as a "brazing material". A bonding technology that uses a filler metal having a melting point of 450° C. or below is referred to "soldering" and the filler metal is referred to as "solder".

In this embodiment, when a corresponding diameter of the high pressure passage 5*a* is Ψh, the passage length Lh of the high pressure passage 5*a* is so set as to be greater than $9.16/\{LN(4.5^{-\Psi h}+1.03)\}$ and smaller than $46/\{LN(4.5^{-\Psi h}+1.03)\}$. When a corresponding diameter of the low pressure passage 5*c* is Ψl, the passage length L1 of the low pressure passage 5*c* is so set as to be greater than $9.16/\{LN(0.56\times 6^{-\Psi l}+1.02)\}$ and smaller than $46/\{LN(0.56\times 6^{-\Psi l}+1.02)\}$.

Furthermore, when the corresponding diameter of the high pressure passage 5*a* is Ψh, the passage sectional area Ah of the high pressure passage 5*a* is so set as to be smaller than $100\times(0.25\times\Psi h^{1.2})^{-1/(0.04\times\Psi h+1.7)}$ and greater than $100\times(500\times\Psi h^{1.2})^{-1/(0.04\times\Psi h+1.7)}$. When the corresponding diameter of the low pressure passage 5*c* is Ψl, the passage sectional area Al of the low pressure passage 5*c* is so set as to be greater than $1.65/\Psi h^{0.67}$ and smaller than $626/\Psi l^{0.67}$. The units of length are millimeters.

Here, the term "corresponding diameter" means the value obtained by multiplying by 4 the sum of the passage sectional areas of the passages 5*a*, 5*c* and dividing the product by the sum of the circumferences of the passages 5*a*, 5*c* corresponding to the length of a wetted perimeter. When each of the passages 5*a* and 5*c* is only one, the passage sectional area of one passage is multiplied by 4 and the product is then divided by the circumference corresponding to the length of the wetted perimeter.

The symbol "LN" is the abbreviation of "Natural Logarithm" as is well known in the art and is a logarithm using e (=2.71828 . . . ) as the base. Therefore, LN 10, for example, means $\log_e 10$.

Next, the features of the internal heat exchanger 5 according to the embodiment will be described.

FIG. 3 shows a numerical value simulation result representing the relation between heat exchange efficiency Q and the passage length Lh of the high pressure passage 5*a* in the high pressure tube 5*b* when the passage sectional diameter Ψ of the high pressure passage 5*a* is used as a parameter and FIG. 4 shows a numerical value simulation result representing the relation between heat exchange efficiency Q and the passage length L1 of the low pressure passage 5*c* in the low pressure tube 5*d* when the passage sectional diameter Ψ of the low pressure passage 5*c* is used as a parameter.

The graph shown in FIG. 3 is numerically formulated as follows:

$$Q=1-(1/4.5^{\Psi h}+1.03)^{-Lh/10}.$$

When this equation is modified as to Lh:

$$LH=10\cdot LN\{1/(1-Q)\}/LN\{1/4.5^{\Psi h}+1.03\}$$

The graph shown in FIG. 4 is numerically formulated as follows:

$$Q=1-(0.56/6^{\Psi l}+1.02)^{-Ll/10}.$$

When this equation is modified as to L1:

$$Ll=10\sim LN\{1/(1-Q)\}/LN\{0.56/6^{\Psi l}+1.02\}$$

In order to let the internal heat exchanger 5 operate as means for improving the capacity of the vapor compression type refrigerator, heat exchange efficiency Q of at least 0.6 is required.

As can be obviously understood from FIGS. 3 and 4, on the other hand, heat exchange efficiency Q substantially gets into saturation at 0.99 and can hardly be improved any longer. Therefore, heat exchange efficiency is preferably a value that is greater than 0.6 and smaller than 0.99.

Therefore, the upper limit values and the lower limit values of the passage length Lh of the high pressure passage 5*a* and the passage length Ll of the low pressure passage 5*c* are determined in the following way on the basis of the equations given above:

$$9.16/\{LN(4.5^{-\Psi h}+1.03)\}<Lh<46/\{LN(4.5-^{\Psi h}+1.03)\}$$

$$9.16/\{LN(0.56\times 6^{\Psi l}+1.02)\}<Ll<46/\{LN(0.56\times 6^{-\Psi l}+1.02)\}$$

Therefore, a compact and high performance internal heat exchange 5 can be obtained by so setting the passage length Lh of the high pressure passage 5*a* as to be greater than $9.16/\{LN(4.5^{-\Psi h}+1.03)\}$ and smaller than $46/\{LN(4.5^{-\Psi h}+1.03)\}$ when the corresponding diameter of the high pressure passage 5*a* is Ψh, and by so setting the passage length Ll of the low pressure passage 5*c* as to be greater than $9.16/\{LN(0.56\times 6^{-\Psi l}+1.02)\}$ and smaller than $46/\{LN(0.56\times 6^{-\Psi l}+1.02)\}$ when the corresponding diameter of the low pressure passage 5*c* is Ψl.

When the passage sectional area of each passage 5*a* and 5*c* increases, the pressure loss occurring inside the passage 5*a* and 5*c* becomes small, so that the velocity of the refrigerant flowing through each passage 5*a* and 5*c* increases and a heat transfer rate increases, too.

When the passage length of each passage 5*a* and 5*c* gets elongated, the contact area between the high pressure tube 5*b* and the low pressure tube 5*d*, that is, the heat exchange area, increases. Consequently, when the passage length of each passage 5*a* and 5*c* increases, the pressure loss occurring in each passage 5*a* and 5*c* increases though the heat exchange quantity between the high pressure side refrigerant and the low pressure side refrigerant increases. As a result, the velocity of the refrigerant flowing through each passage 5*a* and 5*c* drops and the heat transfer rate as well as heat exchange efficiency Q drop.

FIG. 5 shows a numerical value simulation result representing the relation between a pressure loss ΔP/L per unit passage length and the passage sectional area Ah of the high pressure passage 5*a* in the high pressure tube 5*b* when the passage sectional diameter Ψ of the high pressure passage 5*a* is used as a parameter and FIG. 6 shows a numerical value simulation result representing the relation between heat exchange efficiency Q and the passage sectional area Al of the low pressure passage 5*c* in the low pressure tube 5*d* when the passage sectional diameter Ψ of the low pressure passage 5*c* is used as a parameter.

The graph shown in FIG. 5 is numerically formulated as follows:

$$\Delta Ph/Lh=0.02\times\Psi h^{-1.2}\times(100/Ah)^{0.04\times\Psi h+1.7}$$

The graph shown in FIG. 6 is numerically formulated as follows:

$$\Delta Pl/Ll=0.18\times\Psi l^{-1.3}\times(100/Al)^{1.95}$$

Here, to satisfy the requirement for the vapor compression type refrigerator, the pressure loss occurring in the internal heat exchanger 5 must be less than 1,000 kPa. As can be obviously seen from FIGS. 5 and 6, the pressure loss hardly changes with respect to the increase of the passage sectional area when the pressure loss per unit passage length is 0.005 kPa/mm or less. To reduce the size of the internal heat exchanger 5, therefore, the pressure loss per unit passage length is preferably greater than 0.1 kPa/mm.

Therefore, the upper limit values and the lower limit values of the passage sectional area Ah of the high pressure passage 5*a* and the passage sectional area Al of the low pressure passage 5*c* are determined in the following way:

$$100\times(0.25\times\Psi h^{1.2})^{-1/(0.04\times\Psi h+1.7)}>Ah>100\times(500\times\Psi h^{1.2})^{-1/(0.04\times\Psi h+1.7)}$$

$$1.65/\Psi l^{0.67}<Al<626/\Psi l^{0.67}$$

Therefore, a compact and high performance internal heat exchanger 5 can be reliably obtained by so setting the passage sectional area Ah of the high pressure passage 5*a* as to be smaller than $100\times(0.25\times\Psi h^{1.2})^{-1/(0.04\times\Psi h+1.7)}$ and greater than $100\times(500\times\Psi h^{1.2})^{-1(0.04\times\Psi h+1.7)}$ and by so setting the passage sectional area Al of the low pressure passage 5*c* as to be greater than $1.65/\Psi l^{0.67}$ and smaller than $626/\Psi l^{0.67}$.

In this embodiment, the passages 5*a* and 5*c* have a circular sectional shape and a plurality of passages 5*a* and 5*c* exist. Therefore, the number Nh of the high pressure passages 5*a* and the number Nl of the low pressure passages 5*c* are given as follows:

$$400/(\pi\times\Psi h^2)\times(0.25\times\Psi h^{1.2})^{-1/(0.04\times\Psi h+1.7)}>Nh>400/(\pi\times\Psi h^2)\times(500\times\Psi h^{1.2})^{-1/(0.04\times\Psi h+1.7)}2.1/\Psi l^{2.67}<Nl<797/\Psi l^{2.67}$$

As the number Nh of the high pressure passages 5*a* and the number Nl of the low pressure passages 5*c* are the natural numbers, the values obtained by counting fractions are used as the lower limit values of the numbers Nh and Nl and those obtained by omitting the fractions are used as the upper limit values of Nh and Nl.

Second Embodiment

In the first embodiment, the high pressure tube 5*b* and the low pressure tube 5*d* are unified by brazing, etc, but in this embodiment, the high pressure tube 5*b* and the low pressure tube 5*d* are integrally molded by the extrusion process or the drawing process as shown in FIG. 7.

Third Embodiment

In the embodiments given above, the flat tubes constitute the internal heat exchanger. In this embodiment, however, the high pressure passage 5*a* and the low pressure passages 5*c* are aligned on the same axis to form a double wall structure as shown in FIG. 8.

Incidentally, as the high pressure passage 5*a* is only one in this embodiment, the passage sectional area Ah is the passage sectional area of one high pressure passage 5*a* and the passage sectional area Al of the low pressure passages 5*c* is the sum of a plurality of low pressure passages 5*c*.

Though the high pressure passage 5*a* is arranged inside the low pressure passages 5*c* in this embodiment, the embodiment is not limited to this construction and the high pressure passages 5*a* may be arranged outside the low pressure passage 5*c*.

Though the invention is applied to the air conditioner for a car in the embodiments described above, the application of the invention is not limited thereto.

The construction of the internal heat exchanger 5 according to the invention is not limited to those described in the foregoing embodiments.

In the internal heat exchanger 5 according to the invention, both high pressure passage 5*a* and low pressure passage 5*c* extend linearly but the invention is not limited thereto. For examples, both passages 5*a* and 5*c* may well extend in a zigzag form.

While the invention has been described by reference to specific embodiments chosen for the purposes of illustration, it should be apparent that numerous modifications could be made thereto by those skilled in the art without departing from the basic concept and scope of the invention.

What is claimed is:

1. An internal heat exchanger applied to a vapor compression type refrigerator using carbon dioxide as a refrigerant, having a high pressure passage (5*a*) through which a high pressure refrigerant flows and a low pressure passage (5*c*) through which a low pressure side refrigerant flows, and conducting heat exchange between said high pressure side refrigerant and said low pressure side refrigerant while the flow of said high pressure side refrigerant and the flow of said low pressure side refrigerant constitute counter-flows, wherein:

when the length units are millimeters and a corresponding diameter of said high pressure passage (5*a*) is Ψh, a passage length (Lh) of said high pressure passage (5*a*) is greater than $9.16/\{LN(4.5^{-\Psi h}+1.03)\}$ and smaller than $46/\{LN(4.5^{-\Psi h}+1.03)\}$, and when a length unit is millimeter and a corresponding diameter of said low pressure passage (5*c*) is Ψl, a passage length (Ll) of said low pressure passage (5*c*) is greater than $9.16/\{LN(0.56\times 6^{-\Psi l}+1.02)\}$ and smaller than $46/\{LN(0.56\times 6^{-\Psi l}+1.02)\}$.

2. An internal heat exchanger according to claim 1, wherein said high pressure passage (5*a*) and said low pressure passage (5*c*) are aligned on the same axis and constitute a double tube structure.

3. An internal heat exchanger according to claim 1, wherein tubular members constituting said high pressure passage (5*a*) and said low pressure passage (5*c*) are shaped into a flat shape.

4. An internal heat exchanger applied to a vapor compression type refrigerator using carbon dioxide as a refrigerant, having a high pressure passage (5*a*) through which a high pressure refrigerant flows and a low pressure passage (5*c*) through which a low pressure side refrigerant flows, and conducting heat exchange between said high pressure side refrigerant and said low pressure side refrigerant while the flow of said high pressure side refrigerant and the flow of said low pressure side refrigerant constitute counter-flows, wherein:

when the length units are millimeters and a corresponding diameter of said high pressure passage (5*a*) is Ψh, a passage sectional area (Ah) of said high pressure passage (5*a*) is smaller than $100\times(0.25\times\Psi h^{1.2})^{-1/(0.04\times\Psi h+1.7)}$ and greater than $100\times(500\times\Psi h^{1.2})^{-1(0.04\times\Psi h+1.7)}$, and when a length unit is millimeter and a corresponding diameter of said low pressure passage (5*c*) is Ψl, a passage sectional area (Al) of said low pressure passage (5*c*) is greater than $1.65/\Psi l^{0.67}$ and smaller than $626/\Psi l^{0.67}$.

5. An internal heat exchanger according to claim 4, wherein both of said high pressure passage and said low pressure passage (5*c*) are constituted by a plurality of passages, and wherein the number (Nh) of said high pressure passages (5*a*) is smaller than $400/(\pi\times\Psi h^2)\times(0.25\times\Psi h^{1.2})^{-1/(0.04\times\Psi h+1.7)}$ and greater than $400/(\pi\times\Psi h^2)\times(500\times\Psi h^{1.2})^{-1/(0.04\times\Psi h+1.7)}$, and the number (Nl) of said low pressure passages (5*c*) is greater than $2.1/\Psi l^{2.67}$ and smaller than $797/\Psi l^{2.67}$.

6. An internal heat exchanger according to claim 4, wherein said high pressure passage (5*a*) and said low pressure passage (5*c*) are aligned on the same axis and constitute a double tube structure.

7. An internal heat exchanger according to claim 4, wherein tubular members constituting said high pressure passage (5*a*) and said low pressure passage (5*c*) are shaped into a flat shape.

* * * * *